US008292468B2

(12) United States Patent
Narendran et al.

(10) Patent No.: US 8,292,468 B2
(45) Date of Patent: Oct. 23, 2012

(54) SOLID STATE LIGHT SOURCE LIGHT BULB

(75) Inventors: Nadarajah Narendran, Clifton Park, NY (US); Jean Paul Freyssinier, Troy, NY (US); Yiting Zhu, Troy, NY (US)

(73) Assignee: Rensselaer Polytechnic Institute, Troy, NY (US)

( * ) Notice: Subject to any disclaimer, the term of this patent is extended or adjusted under 35 U.S.C. 154(b) by 0 days.

(21) Appl. No.: 13/376,887

(22) PCT Filed: Jun. 9, 2010

(86) PCT No.: PCT/US2010/037965

§ 371 (c)(1),
(2), (4) Date: Dec. 8, 2011

(87) PCT Pub. No.: WO2010/144572

PCT Pub. Date: Dec. 16, 2010

(65) Prior Publication Data

US 2012/0081880 A1 Apr. 5, 2012

Related U.S. Application Data

(60) Provisional application No. 61/268,230, filed on Jun. 10, 2009.

(51) Int. Cl.
*F21V 7/00* (2006.01)

(52) U.S. Cl. ..... 362/310; 362/231; 362/294; 313/317; 313/318.11; 313/485

(58) Field of Classification Search ..... 362/227, 362/230, 231, 238, 240, 241, 243–245, 249.01, 362/249.02, 249.11, 255, 294, 304, 305, 362/310, 311.01, 326, 327, 329, 373, 377, 362/551, 555, 558, 577, 600, 606, 608, 613, 362/615–617, 649, 650, 800; 313/44–46, 313/317, 318.01, 318.04, 318.11, 318.12, 313/485–487, 498–504, 512
See application file for complete search history.

(56) References Cited

U.S. PATENT DOCUMENTS 6,373,188 B1 4/2002 Johnson (Continued)

FOREIGN PATENT DOCUMENTS

EP 1930959 6/2008

OTHER PUBLICATIONS

Schubert E. F., "Solid-State Lighting—a Benevolent Technology", Reports on Progress in Physics, Nov. 2, 2006, 3069-3099.

(Continued)

*Primary Examiner* — Hargobind S Sawhney
(74) *Attorney, Agent, or Firm* — RatnerPrestia

(57) ABSTRACT

A light emitting apparatus includes a lamp base, a light-transmissive bulb envelope, a light source for emitting light, and a heat sink coupled to the light source. A solid state LED light bulb may further include a down conversion material. The down conversion material is disposed within the bulb envelope, remote from the light source and between the light source and the lamp base. The heat sink may include at least one metal fin and, additionally or alternatively, include a mesh disposed over at least an outer portion of the bulb envelope. A solid state light bulb may include a light guide for directing the light emitted by the light source. The solid state light bulb configurations place the light source and heat sink at the apex of the light bulb envelope, distant from the lamp base, in order to dissipate heat produced by the light source into the environment. In addition, at least part of the heat sink is outside the light bulb envelope to maximize the heat dissipation.

20 Claims, 14 Drawing Sheets

U.S. PATENT DOCUMENTS

| | | | | |
|---|---|---|---|---|
| 6,659,632 | B2 * | 12/2003 | Chen | 362/545 |
| 7,226,189 | B2 * | 6/2007 | Lee et al. | 362/294 |
| 7,245,072 | B2 | 7/2007 | Ouderkirk | |
| 2005/0174780 | A1 * | 8/2005 | Park | 362/294 |
| 2006/0072314 | A1 | 4/2006 | Rains | |
| 2006/0098440 | A1 * | 5/2006 | Allen | 362/294 |
| 2007/0012887 | A1 | 1/2007 | Letz | |
| 2008/0030993 | A1 | 2/2008 | Narendran | |
| 2008/0084700 | A1 | 4/2008 | Van De Ven | |
| 2008/0142820 | A1 | 6/2008 | Edmond | |
| 2008/0211386 | A1 | 9/2008 | Choi | |
| 2008/0308824 | A1 | 12/2008 | Shchekin | |
| 2009/0141474 | A1 | 6/2009 | Kolodin | |

OTHER PUBLICATIONS

International Application Serial No. PCT/US2010/037965, International Search Report mailed Dec. 23, 2010, 2 pgs.

* cited by examiner

SOLID STATE LIGHT SOURCE LIGHT BULB

CROSS-REFERENCE TO RELATED APPLICATIONS

This application is a U.S. National Phase Application of PCT International Application No. PCT/US2010/037965 filed Jun. 9, 2010 which claimed the benefit of the filing date of U.S. provisional patent application Ser. No. 61/268,230, filed Jun. 10, 2009, the disclosure of which is incorporated herein by reference.

FIELD OF THE INVENTION

The present invention relates generally to solid-state lighting. Specifically, the present invention relates to a light bulb using solid-state light (SSL) sources, remote phosphor, and a heat sink.

BACKGROUND OF THE INVENTION

Solid state light (SSL) emitting devices, including solid state lamps having light emitting diodes (LEDs) are extremely useful, because they potentially offer lower fabrication costs and long term durability benefits over conventional incandescent and fluorescent lamps. Due to their long operation (burn) time and low power consumption, solid state light emitting devices frequently provide a functional cost benefit, even when their initial cost is greater than that of conventional lamps. Because large scale semiconductor manufacturing techniques may be used, many solid state lamps may be produced at extremely low cost.

In addition to applications such as indicator lights on home and consumer appliances, audio visual equipment, telecommunication devices and automotive instrument markings, LEDs have found considerable application in indoor and outdoor informational displays.

With the development of efficient LEDs that emit blue or ultraviolet (UV) light, it has become feasible to produce LEDs that generate white light through phosphor conversion of a portion of the primary emission of the LED to longer wavelengths. Conversion of primary emissions of the LED to longer wavelengths is commonly referred to as down-conversion of the primary emission. This system for producing white light by combining an unconverted portion of the primary emission with the light of longer wavelength is well known in the art. Other options to create white light with LEDs include mixing two or more colored LEDs in different proportions. For example, it is well known in the art that mixing red, green and blue (RGB) LEDs produces white light. Similarly, mixing RBG and amber (RGBA) LEDs, or RGB and white (RGBW) LEDs, are known to produce white light.

The use of reflective surfaces is also well known in the art. Reflective surfaces have been used to direct light from the LED to the down-conversion material and/or to reflect down converted light which is generated from the down-conversion material. Even with these improvements, the current state of the art LED technology is inefficient in the visible spectra. The light output for a single LED is below that of known incandescent lamps, which are approximately 10 percent efficient in the visible spectra. To achieve comparable light output power density to current incandescent lamps, an LED device often requires a larger LED or a design having multiple LEDs. However, designs incorporating a larger LED or multiple LEDs have been found to present their own challenges.

Recent studies have determined that the heat generated from LEDs decreases overall light emission and bulb durability. More particularly, the LED device becomes less efficient when heated to a temperature greater than 100° C., resulting in a declining return in the visible spectra. Extended exposure to high heat also reduces the effective life of the LEDs. Additionally, the intrinsic down conversion efficiency for some down conversion phosphors also drops dramatically as the temperature increases above approximately 90° C. threshold.

Attempts to overcome these deficiencies have been focused on bulb designs that are unlike traditional incandescent lamps. The use of heat sinks at the base of the bulb has assisted in heat dissipation, but has led to lamp designs having significantly different aesthetics and light distribution functionality from traditional incandescent lamps. Even though solid state light emitting devices have been advancing rapidly and have exceeded the luminous efficacy of traditional A-lamp incandescent bulbs, there are no SSL-based replacement light bulbs that can produce light levels similar to incandescent lamps, have very high luminous efficacy values, and much longer life time. Thus, there is a particular need for solid state light emitting devices which can replace traditional incandescent lamps by providing similar or improved performance efficiency, life span durability, and bulb aesthetics.

SUMMARY OF INVENTION

To meet this and other needs, and in view of its purpose, the present invention provides a light emitting apparatus including a lamp base; a light-transmissive bulb envelope, a first portion of the bulb envelope coupled to the lamp base; a light source for emitting light, at least a portion of the light source disposed within the bulb envelope at an end substantially opposite the lamp base; and a heat sink coupled to the light source, at least a portion of the heat sink external to the bulb envelope. The light source may be, for example, at least one light emitting diode (LED).

In another embodiment, the present invention further includes a down conversion material for receiving and down converting at least some of the light emitted by the light source and back transferring a portion of the received and down converted light. The down conversion material is disposed within the bulb envelope, remote from the light source and between the light source and the lamp base. One or more wavelength-converting materials are used to absorb radiation in one spectral region and emit radiation in another spectral region, and the wavelength-converting material can be either a down-converting or an up-converting material. Multiple wavelength-converting materials are capable of converting the wavelength emitted from the light source to the same or different spectral regions. In some embodiments of the present invention, for example those employing a white LED as the light source, a down conversion material may not be necessary as the emitted light is already substantially similar to that produced by an incandescent lamp.

In yet another embodiment of the present invention, a light emitting apparatus further includes a first reflector for receiving and reflecting the light emitted by the light source. The reflector is disposed within the bulb envelope between the light source and the lamp base. In a further embodiment, the reflector is adjacent the down conversion material. In some embodiments of the present invention, the apparatus may include at least a second reflector for directing the light emitted from the light source, the light source disposed within the reflector. The second reflector may be at least one reflector cup or optical lens. When the light source employs a plurality of light emitting diodes, the light emitting diodes may be respectively disposed within at least one reflector.

In still another embodiment of the present invention, at least a portion of the heat sink projects into the bulb envelope. The heat sink may include at least one metal fin and, additionally or alternatively, include a mesh disposed over at least an outer portion of the bulb envelope. Various embodiments of the present invention may further include standard bulb components such as, for example, an electronic driver disposed within the bulb envelope to condition the voltage and current and/or at least one electrical conductor disposed within the bulb envelope to couple electrical current between the lamp base and the light source. In some embodiments which include an electronic driver, at least a portion of the electronic driver is disposed within the lamp base.

Another embodiment of the present invention further includes a light guide for directing the light emitted by the light source. A first end of the light guide is coupled to the light source and a second end of the light guide is coupled to the down conversion material. The light guide can take many shapes and sizes. For example, in certain embodiments, the light guide is a cylinder or a tapered cylinder. In other embodiments. The tapered cylinder light guide may have an upper portion that is angle cut, flat, pointed, spherical, hemispherical, or conical. In some embodiments, the remote down conversion material is placed at these end finishes at the top portion of the light guide.

The embodiments of the present invention place the light source and heat sink at the apex of the light bulb envelope, distant from the lamp base, in order to dissipate more of the heat produced by the light source into the environment. This arrangement enables a greater amount of light to be produced, compared to commercially available SSL-based replacement light bulbs which place the light source and, optionally, heat sink at the lamp base. The configurations of the present invention also aid to ensure that temperatures of the bulb components are maintained, thereby prolonging bulb durability and life span.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following Figures:

FIG. 4(*b*) illustrates a cross-sectional view of a light source, a light collimation lens, and a conical light guide, in accordance with another embodiment of the present invention;

FIGS. 4(*c*)-4(*e*) illustrate a cross-sectional view of a light source, a light collimation lens, and a conical light guide having a flattened tip, in accordance with other embodiment of the present invention;

FIG. 5(*e*) is a 90° rotated view of the embodiment shown in FIG. 5(*d*);

FIG. 8(*b*) shows a 3-dimensional exploded view of the embodiment shown in FIG. 8(*a*).

FIG. 9(*b*) shows a 3-dimensional exploded view of the embodiment shown in FIG. 9(*a*);

FIG. 10(*b*) shows a cross-sectional view of the embodiment of the present invention shown in FIG. 10(*a*);

FIG. 11(*b*) shows a 3-dimensional, cross-sectional view of the embodiment of the present invention shown in FIG. 11(*a*);

FIG. 12(*b*) shows a 3-dimensional, cross-sectional view of the embodiment of the present invention shown in FIG. 12(*a*);

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The inventors have discovered that performance of the solid state light (SSL) emitting device is negatively effected when the light source, such as a light emitting diode (LED), is placed at or within the lamp base. Positioning the light source at the lamp base has been found to produce heat levels that are detrimental to the efficiency, light production, and life span of the SSL-based lamp. Attempts to overcome these deficiencies have been focused on bulb designs that are unlike traditional incandescent A-lamps.

Figure 1:
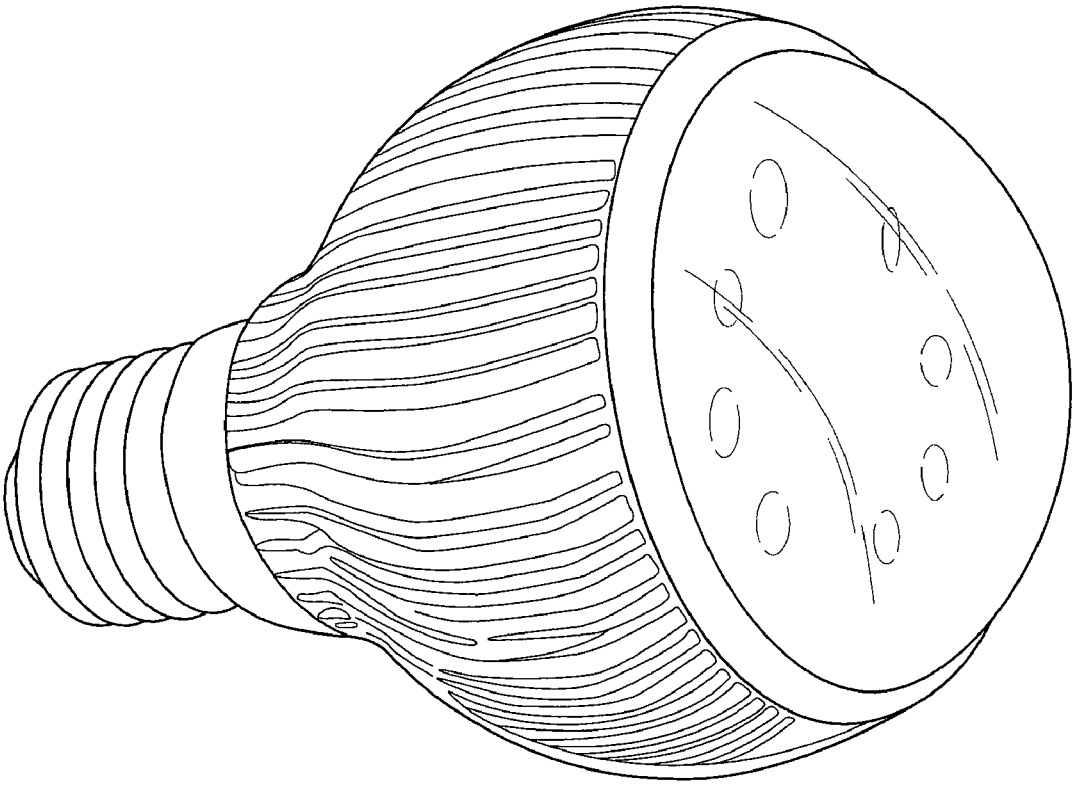
FIG. 1 (Prior Art)
FIG. 1 is an illustration of a prior art commercial LED-based lamp.

In commercially available LED-based products, the heat sink, if at all present, is typically positioned between the base of the lamp and the LED sources to help dissipate heat. In most cases, the heat sink is integrated with the base of the lamp. However, positioning the heat sink at or within the lamp base prevents proper heat management of the LEDs. This is because a large percentage of the heat is simply transferred from the back of the LEDs to the base of the lamp, instead of being dissipated away from the LEDs to the environment. For example, FIG. 1 shows a commercial LED-based replacement lamp which utilizes a heat dissipation element at the lamp base. While the use of heat sinks at the base of the bulb in this manner may assist in heat dissipation, the light beam distributed from such replacement bulbs are significantly different from the light distributed from traditional incandescent light bulbs.

Additionally, current commercially available replacement lamp designs have significantly different aesthetics and light distribution functionality from traditional incandescent lamps. For example, due to the location and shape of the heat sinks employed in commercially-available LED-based products, most of the light in the direction of the heat sink is blocked. This has been shown to result in shadows behind the lamp which are not typical of, and dissimilar from, the incandescent lamps intended to be replaced by the SSL-based lamp. At a minimum, this change in light distribution may create a problem in appearance. In other cases, the difference in light distribution may result in completely unacceptable performance from a luminaire that was designed for incandescent lamps.

The present invention addresses these problems by positioning the light source at an end of the bulb envelope that is substantially opposite the incandescent A-lamp base. The light source may be at least one semiconductor light emitting diode, such as a light emitting diode (LED), a laser diode (LD), or a resonant cavity LED (RCLED). Embodiments of the present invention may utilize a single SSL source, such as a single LED, or may include multiple SSL sources (i.e., a plurality of LEDs) as the light source. The light source may be coupled to a heat sink, with at least a portion of the heat sink external to the bulb envelope. Positioning the light source in the configuration of the present invention minimizes the effect of intrinsic heat at the lamp base on the light source. Additionally, the heat sink functions as a heat dissipation element for the light source, enabling heat to be drawn away from the light source. The heat sink may also provide mechanical support to the light source. For example, the heat sink may be external to the bulb envelope but coupled to the internal light source at a break-through in the bulb envelope. This coupling effectively retains the light source within the bulb envelope while also sealing the bulb envelope closed. These design features of the present invention enable the replacement bulb to have very high luminous efficacy values and produce light levels similar to incandescent lamps, while also prolonging the life span durability of the SSL-based lamp.

The use of down conversion materials aids in the production of light that is aesthetically similar to that which is produced by traditional incandescent A-lamps. It will be appreciated that the terms "down conversion," "down converting," and "down-converted" refer to materials which are adapted to absorb radiation in one spectral region and emit radiation in another spectral region. As described above, the down conversion material of the present invention may be composed of one or more wavelength-converting materials adapted to absorb radiation in one spectral region and emit radiation in another spectral region, and the wavelength-converting material can be either a down-converting or an up-converting material. As such, embodiments of the present invention may incorporate wavelength converting materials that are down-converting, up-converting, or both. Accordingly, the term "down conversion material" is defined as materials that can, through their composition, absorb radiation in any spectral region and emit it in another spectral region. It will also be appreciated that the terms "transmitted light" and "reflected light" are used throughout this application. However, more precisely the terms are "forward transmitted light" and "backwards transmitted light," respectively. As light emitted from the light source reaches the down conversion material, the down conversion material absorbs the short wavelength light and emits down converted light. The emitted down converted light may travel in all directions (known as a Lambertian emitter), and therefore, a portion of the down converted light travels upwards while another portion travels downwards. The light that goes upwards (or outwards) from the down conversion material is the forward transmitted portion of the light and the light that comes downwards towards the light source is the backwards transmitted portion.

The problem of low performance of existing replacement bulbs is also solved, in some embodiments of the present invention, by implementing a remote down conversion concept. In a system employing a remote down conversion concept, short wavelength radiant energy from the light source is emitted towards a down conversion material which is positioned away from the light source. At least a portion of the radiant energy hitting the down conversion material is down converted to a longer wavelength radiation and, when both radiations mix, results in a white light similar to the light produced by an incandescent A-lamp. The down conversion material may be composed of one or more wavelength-converting materials adapted to absorb radiation in one spectral region and emit radiation in another spectral region. Multiple wavelength-converting materials are capable of converting the wavelength emitted from the light source to the same or different spectral regions. In some embodiments of the present invention employing a white LED as the light source, a down conversion material may not be necessary as the emitted light is already substantially similar to that produced by an incandescent lamp. In other embodiments employing a white LED, a particular down conversion material such as, for example, a "red" phosphor may be selected to enhance the color rendering properties of the white LED. Such a configuration would enable, for example, the use of generic white LEDs with medium-quality color rendering properties to obtain white light output from LED-lamp with better or higher color rendering properties.

A reflector may be utilized to receive and reflect light emitted by the light source and down converted by the down conversion material (i.e. forward transmitted light). The reflector may take any geometric shape such as, for example, spherical, parabolic, conical, and elliptical, and may be comprised of a variety of reflective surfaces known in the art. For example, the reflector may be aluminum, plastic with a vaporized aluminum reflective layer, or any other kind of reflective surface. The reflector is positioned between the down conversion material and the lamp base, and may be separate from, or adjacent to, the down conversion material. In at least one embodiment of the present invention, the down conversion material is applied to, and contained on, the reflector using conventional techniques known in the art. By capturing both the forward transmitted portion and the backwards transmitted portion of the emitted and down converted light, system efficiency may be improved. Similarly, the position of the down conversion material and the reflector may be adjusted to ensure that light from the light source impinges the down conversion material uniformly to produce a uniform white light and allowing more of the light to exit the device. At the same time, positioning the down conversion material remote from the light source prevents light feedback back into the light source. As a result, the heat at the light source is further minimized and results in improved bulb life durability.

Optionally, a second reflector may be employed to direct light emitted from the light source. Suitable second reflectors include, for example, a reflector cup or an optical lens. When a second reflector is employed, the light source may be disposed within the second reflector. When a plurality of SSL sources are employed as the light source, each SSL source may be disposed in respective second reflectors. Alternatively, all of the SSL sources may be disposed within one second reflector. The second reflector may take any geometric shape such as, for example, spherical, parabolic, and elliptical, and may be comprised of a variety of materials known in the art. For example, when an optical lens is employed as a second reflector, the lens may be any light-transmissive material such as glass and plastic. The second reflector functions to direct light emitted from the light source and can be configured to direct substantially all of the light emitted from the light source to the down conversion material. In certain embodiments, the second reflector may be a component of, and integral to, the heat sink. For example, a portion of the heat sink coupled to the light source may be, or have the functionality of, a second reflector. In this configuration, the second reflector collects the light that is emitted sideways by the light source and directs it away from the light source. This design increases optical efficiency.

A light guide may be utilized to further mimic the aesthetics and performance of a traditional incandescent A-lamp. For example, a first end of the light guide may be coupled to the light source and a second end of the light guide may be coupled to the down conversion material. These components may be configured within the bulb envelope to mimic the filament aesthetic of a traditional incandescent A-lamp. Similarly, when the light source is disposed within a second reflector, the light guide may direct light from the light source and second reflector to the down conversion material. Additionally, as the light guide may be designed in various shapes and sizes, it can be fabricated and positioned to direct substantially all of the light emitted from the light source to the down conversion material, increasing the efficiency of the SSL device.

The solid state light emitting device of the present invention may further include other components that are known in the art. For example, the SSL device may further include an electronic driver. Most SSL sources are low voltage direct current (DC) sources. Therefore an electronic driver is needed to condition the voltage and the current for use in the SSL-based lamp. Alternatively, there are several alternating current (AC) SSL sources, such as AC-LEDs sold under trade name of "Acriche" by Seoul Semiconductor, Inc. of Seoul, South Korea. In these cases the SSL source (e.g., the LED or LED array) can be directly connected to the AC power available from the grid. Thus embodiments of the present invention may optionally include an electronic driver, at least a portion of which is Inside the A-lamp base, depending on the type of SSL source employed in the SSL-based lamp. The present invention may further include at least one electronic conductor such as a connection wire. The electronic conductor may be disposed within the bulb envelope to couple electrical current between the lamp base and the light source.

Figure 2:
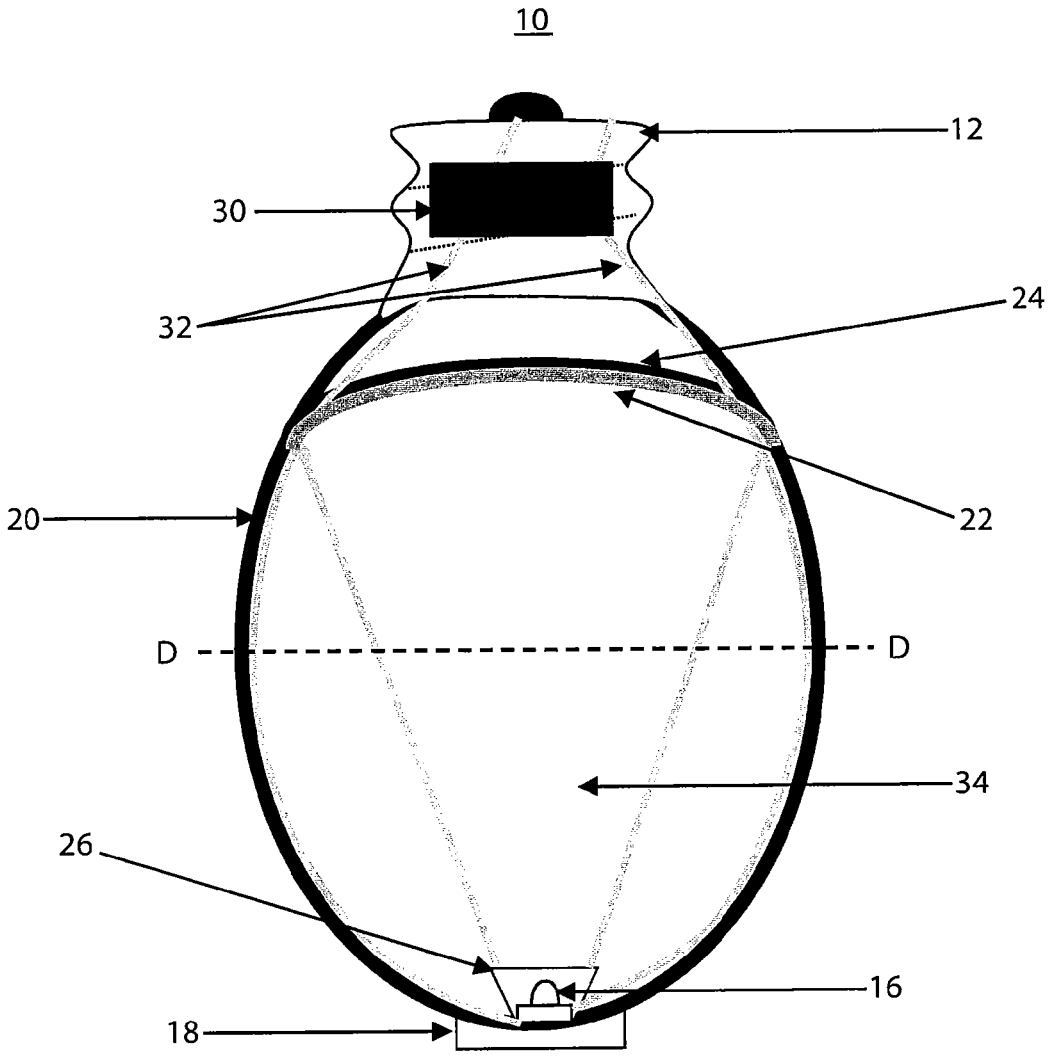
FIG. 2 is a cross-sectional illustration of a solid-state light source light bulb, in accordance with a first embodiment of the present invention.

FIG. 2 illustrates a first exemplary embodiment of the invention having a lamp base 12 that is, for example, the same size and shape of a traditional incandescent A-lamp, a light-transmissive bulb envelope 20, a light source 16 for emitting light, a down conversion material 22, a reflector 24, and a heat sink 18. Lamp base 12 is a standard base that is identical to the base found in current incandescent lamps. Bulb envelope 20 can be made of various light-transmissive materials such as, for example, plastic or glass. As shown, a first portion of the bulb envelope 20 is coupled to the lamp base 12, and at least a portion of the light source 16 is disposed within the bulb envelope 20 at an end substantially opposite the lamp base 12. A down conversion material 22 is disposed within the bulb envelope 20. The reflector 24 is also disposed within the bulb envelope 20 between the down conversion material 22 and the lamp base 12.

Figure 8A:
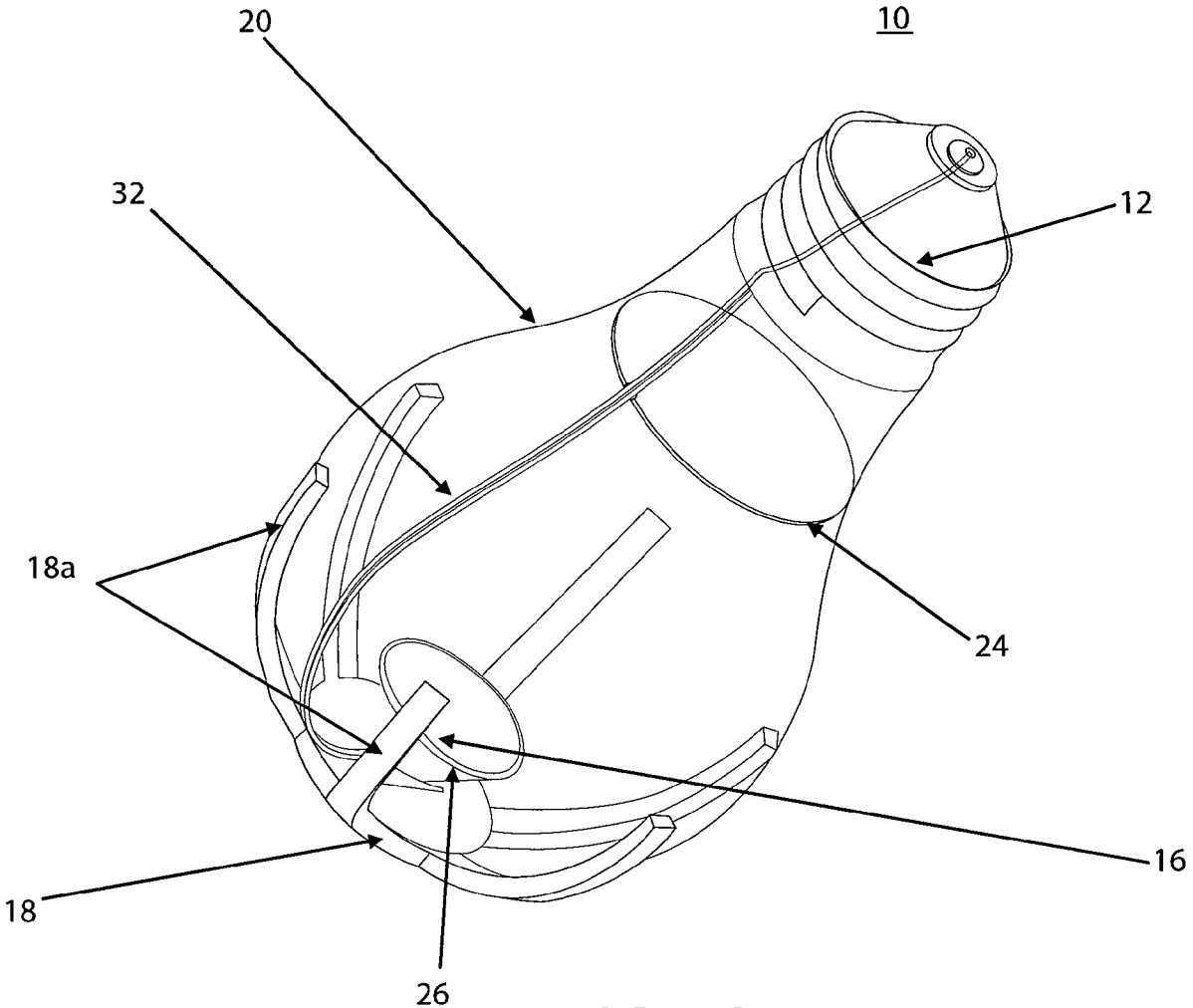
FIG. 8(*a*) shows a 3-dimensional rendering of one embodiment of the present invention which features a white LED package.
Figure 8B:
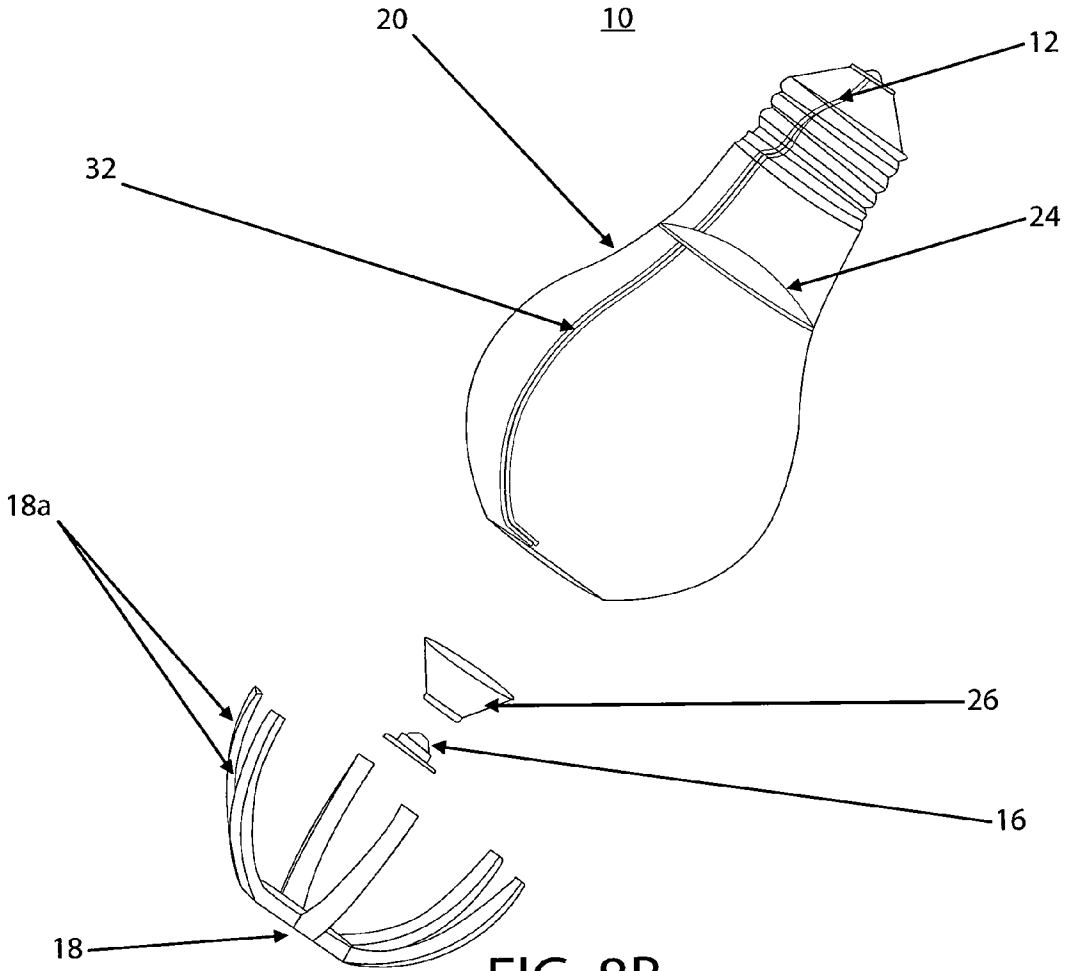

A heat sink 18 is shown to be located at the bottom of the bulb envelope 20, at an end substantially opposite the lamp base 12. At least a portion of the heat sink 18 is external to the bulb envelope 20. The heat sink may comprise a series of metal fins (shown in FIGS. 8*a* and 8*b* as metal fins 18*a*). The heat sink could alternatively, or additionally, include a mesh that extends from heat sink 18 and surrounds at least a portion of the outer surface of the bulb envelope 20 between the light source 16 and the bottom of the lamp base 12. The heat sink 18 may be manufactured of various heat dissipation materials known in the art, such as aluminum or copper. The heat sink may be painted in a color, for example painted in white, to enhance or alter the heat dissipation capability of the material. At least a portion of the heat sink 18 is external to the bulb envelope 20, but the heat sink 18 is coupled to the internal light source 16. This can be achieved, for example, at a breakthrough in the bulb envelope 20 at an end substantially opposite the lamp base 12. This coupling effectively retains the light source 16 substantially within the bulb envelope 20 while also sealing the bulb envelope 20 closed. Once assembled, the inside of the bulb envelope 20 may be a vacuum or may be filled with an inert gas, for example, argon or krypton.

FIG. 2 shows an electronic driver 30 connected via electrical conductor 32 to the light source 16. As described above, the electronic driver 30 is optionally included to condition the voltage and current for use in a SSL-based lamp which utilizes DC SSL sources. Alternatively, the electronic driver 30 is not required when an AC SSL source is selected. Thus, embodiments of the present invention may optionally include an electronic driver 30, at least a portion of which is inside the lamp base 12, depending on the type of SSL source employed in the SSL-based lamp. At least one electronic conductor 32, such as a connection wire, may also be employed in the embodiment of the present invention shown in FIG. 2. The electronic conductor 32 may be disposed within the bulb envelope to couple electrical current between the input at the lamp base 12 and the light source 16, passing through electronic conductor 32 if needed.

The light source 16 may be positioned inside a second reflector 26, which may be a reflector cup with an open top. The light source may include multiple SSL sources, such as multiple LEDs, each inside its own second reflector 26. The second reflector 26 focuses light emitted from the light source 16 upward toward a down conversion layer 22, which may be a phosphor, and a reflector 24. A lens may be used instead of, or in addition to, a reflector cup as the second reflector 26. Reflector 24 and second reflector 26 may be aluminum, plastic with a vaporized aluminum reflective layer, or any other type of highly reflective surface. By directing the light emitted from the light source 16 to the down conversion material 22, the second reflector 26 minimizes the possibility of light exiting the sides of the bulb envelope 20 while it is being transmitted from the light source 16 to the down conversion material 22 and the reflector 24. In the illustrated embodiment, reference number 34 identifies a light beam, not a physical element, and is not a claimed component of the invention.

In this exemplary embodiment, the down conversion material 22 is positioned closer to the lamp base 12 than it is to the light source 16, and the reflector 24 is adjacent the down conversion material 22. In an alternative embodiment, down conversion material 22 may be positioned across the middle of the bulb at position D, for example, and reflector 24 may be positioned away from the down conversion material 22. In such an embodiment, some of the light reflected from reflector 24 may escape through the sides of the bulb envelope 20 located between the reflector 24 and the down conversion material 22. The down conversion material 22 could also be at a position that is above the center position D of the bulb envelope 20 (i.e., further away from the lamp base). When light from the light source 16 hits the down conversion material 22 and reflector 24, some light is reflected back (i.e., backwards transmitted) from the down conversion material and exits from the sides of the bulb envelope 20. Whatever light goes through the down conversion material 22 (i.e., forwards transmitted), is reflected back by reflector 24, and exits the sides of the bulb envelope 20. Although the down conversion material 22 and reflector 24 are shown as traversing the entire width of the bulb envelope 20, these components may be less than the entire width. The positions of the down conversion material 22 and the reflector 24 within the bulb envelope 20, as well as the size and shape of these components, are adjusted to achieve the performance efficiency desired of the SSL-based lamp, as is understood by one having ordinary skill in the art.

In exemplary or alternative embodiments, the down conversion material layer may include one or more phosphors. For example, the down conversion material may include one or more of the following: yttrium aluminum garnet doped with cerium (YAG:Ce), strontium sulfide doped with europium (SrS:Eu), YAG:Ce phosphor doped with europium; YAG:Ce phosphor plus cadmium-selenide (CdSe) or other types of quantum dots created from other materials including lead (Pb) and silicon (Si); and other phosphors known in the art. It will be understood that other embodiments of the present invention may include an embedded phosphor layer or a phosphor layer that is not embedded. Moreover, the phosphor layer need not be of uniform thickness, rather it may be of different thicknesses or different phosphor mixes to create a more uniform color output. The down conversion layer may similarly include other phosphors, quantum dots, quantum dot crystals, quantum dot nano crystals, or other down conversion materials known in the art. The down conversion material may be a wavelength-converting crystal instead of a powdered material mixed with a binding medium. As is known to one having ordinary skill in the art, the down conversion material layer may include additional scattering particles, such as micro spheres, to improve mixing of light of different wavelengths. In an alternative embodiment, the wavelength-converting material layer may be comprised of multiple continuous or discrete sub-layers, each containing similar or different wavelength-converting materials. The down conversion material or individual wavelength-converting layers may be formed by any suitable technique known in the art, such as by, for example, mounting, coating, depositing, stenciling, and screen printing.

Figure 3:
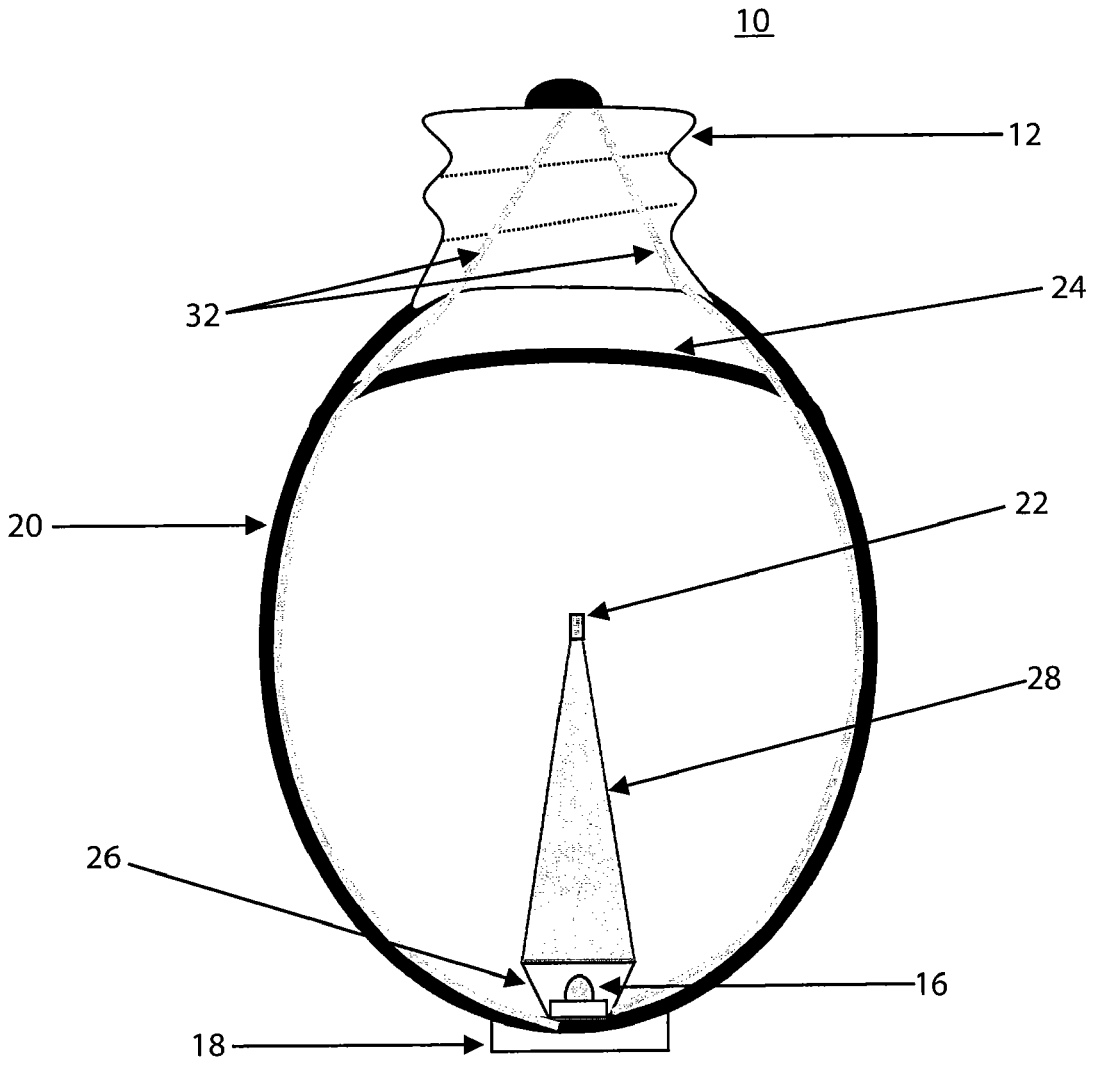
FIG. 3 is a cross-sectional illustration of a solid-state light source light bulb, in accordance with another embodiment of the present invention.

FIG. 3 illustrates another embodiment of the present invention having a lamp base 12, a light-transmissive bulb envelope 20, a light source 16 for emitting light, a down conversion material 22, a reflector 24, and a heat sink 18. This embodiment additionally includes a light guide 28. A first end of the light guide 28 is coupled to the light source 16 and a second end of the light guide 28 is coupled to the down conversion material 22, all of which is located substantially within a bulb envelope 20. This embodiment shows that the light source 16 is disposed within a second reflector 26, also substantially within the bulb envelope 20. A reflector cup is shown in FIG. 3 but, as before, an optical lens may be utilized in place of, or addition to, the reflector cup as a second reflector. Accordingly, the light guide 28 directs light from the light source 16 and second reflector 26 to the down conversion material 22. Alternatively, the light guide 28 may be coupled to, and guide light directly from, the light source 16 when a second reflector is not employed. In the embodiment shown in FIG. 3, the down conversion material 22 is a small cylinder of wavelength-converting material instead of a layer of material. The down conversion material 22 may be located in a central portion of the bulb, as shown in FIG. 3, or positioned in another location to achieve the performance and aesthetic goals of the SSL-based lamp. These components may be configured within the bulb envelope 20 to mimic the filament aesthetic of a traditional incandescent A-lamp. For example, by positioning a cylindrical down conversion material 22 at the center of the bulb, atop a tapered light guide 28, a point source of light similar to a standard tungsten filament point source of light is achieved. FIG. 3 also shows a reflector 24 that is spaced away from the down conversion material 22. In this embodiment, not much light reflected from reflector 24 will impact the down conversion material 22 because the down conversion material is so small. However, the light guide 28 functions to ensure that substantially all of the light emitted from the light source 16 is directed to the down conversion material 22, where it may be down converted and exit the bulb envelope 20 as white light.

Figures 4A, 4B, 4C, 4D, 4E:
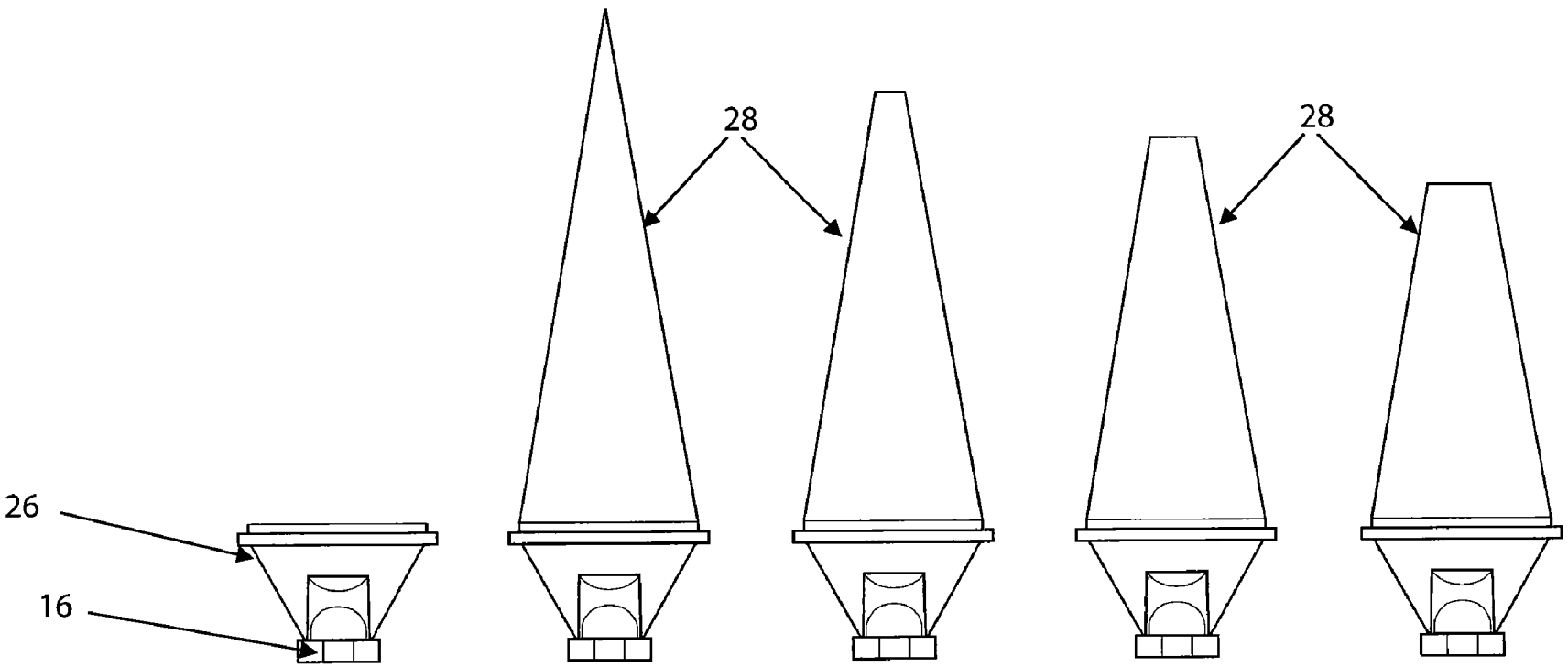
FIG. 4(*a*) illustrates a cross-sectional view of a light source and a light collimation lens, in accordance with another embodiment of the present invention.

FIGS. 4(*a*)-4(*e*) show various embodiments of the present invention utilizing a second reflector. These figures show the second reflector as an optical lens, but the second reflector may be also be a reflector cup. An SSL source, such as an LED, may be placed within the optical lens, as shown in FIG. 4(*a*). FIGS. 4(*b*)-4(*e*) further include a light guide. The light source, second reflector, and light guide are located substantially within the bulb envelope. The lens and the light guide may be manufactured as a single component, or may comprise two separate components. The light guide can take many shapes and sizes. For example, the light guide may be a tapered cylinder, as shown in FIGS. 4(*b*)-4(*e*), or it can be a straight cylinder. The top portion of the light guide can be pointed, as shown in FIG. 4(*b*), or flat, as shown in FIGS. 4(*c*)-4(*e*). FIGS. 4(*c*)-4(*e*) also show that the light guide may be of various lengths and dimensions. For example, FIGS. 4(*c*)-4(*e*) feature light guides that are 40 mm, 35 mm, and 30 mm in length, respectively.

Figures 5A, 5B, 5C, 5D, 5E:
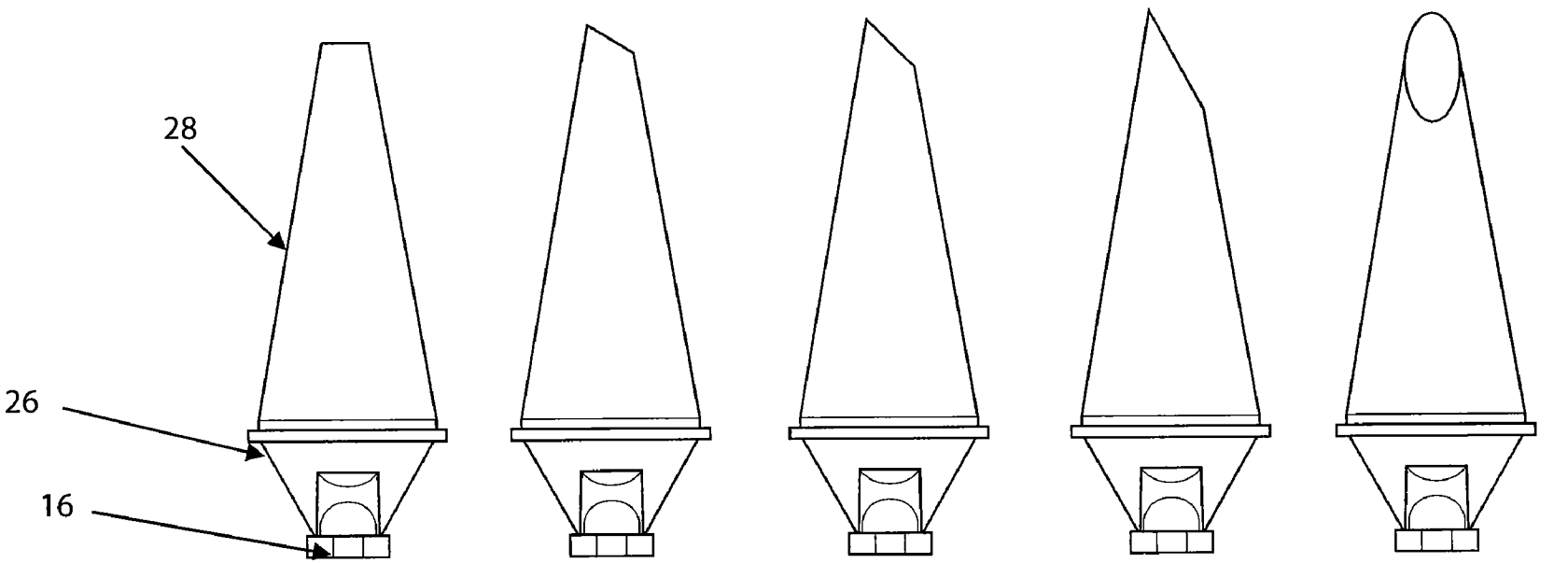
FIGS. 5(*a*)-5(*d*) illustrate a cross-sectional view of a light source, a light collimation lens, and a conical light guide having a flattened tip with a flat surface orientation of 0°, 30°, 45°, and 60°, respectively, in accordance with further embodiments of the present invention.
Figure 6C:
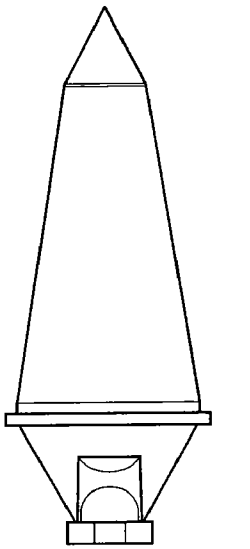
FIGS. 6(*a*)-6(*c*) illustrate tapered light guides with the conical shaped top surface having an apex angle of 120°, 90°, and 60°, respectively, in accordance with yet further embodiments of the present invention.
Figure 6B:
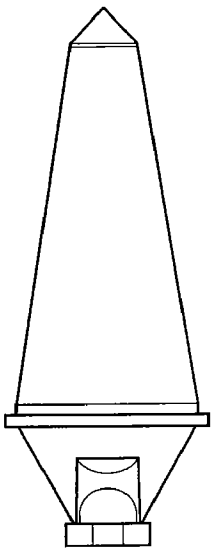
Figure 6A:
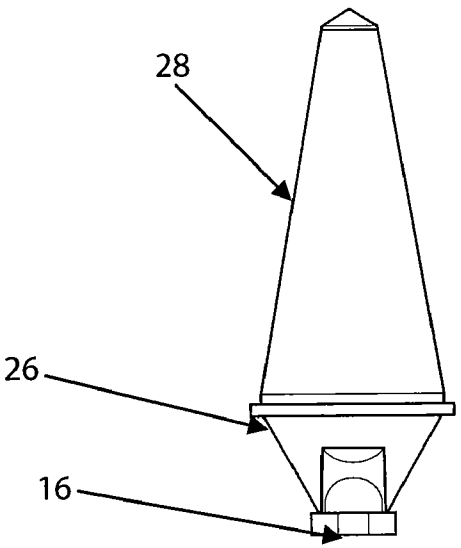
Figure 7B:
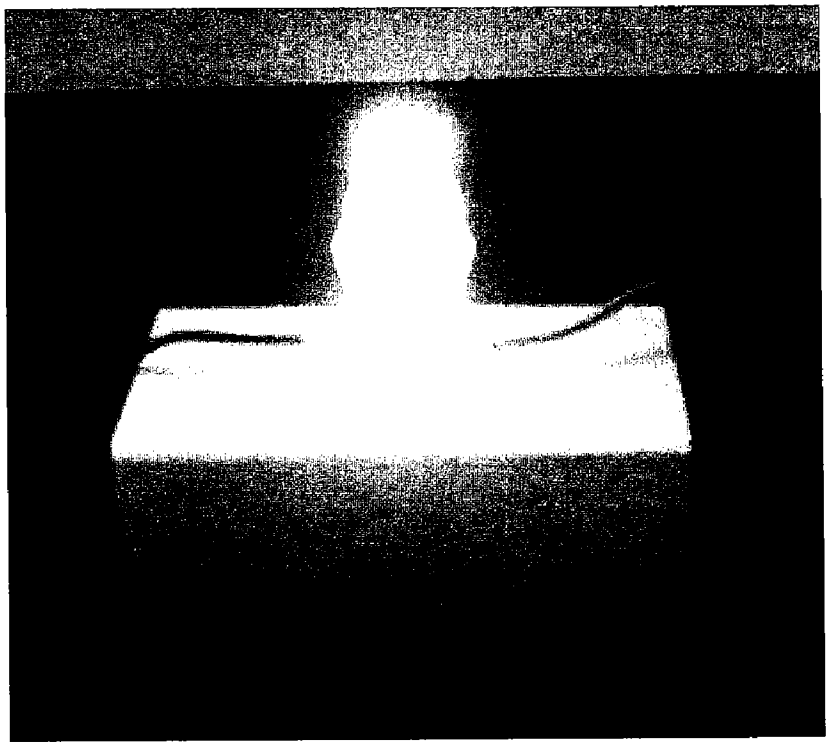
FIGS. 7(*a*)-(*b*) show a blue light emitting diode (LED) with a tapered light guide having a phosphor-coated top surface, in accordance with an embodiment of the present invention, under "off" and "on" conditions, respectively.
Figure 7A:
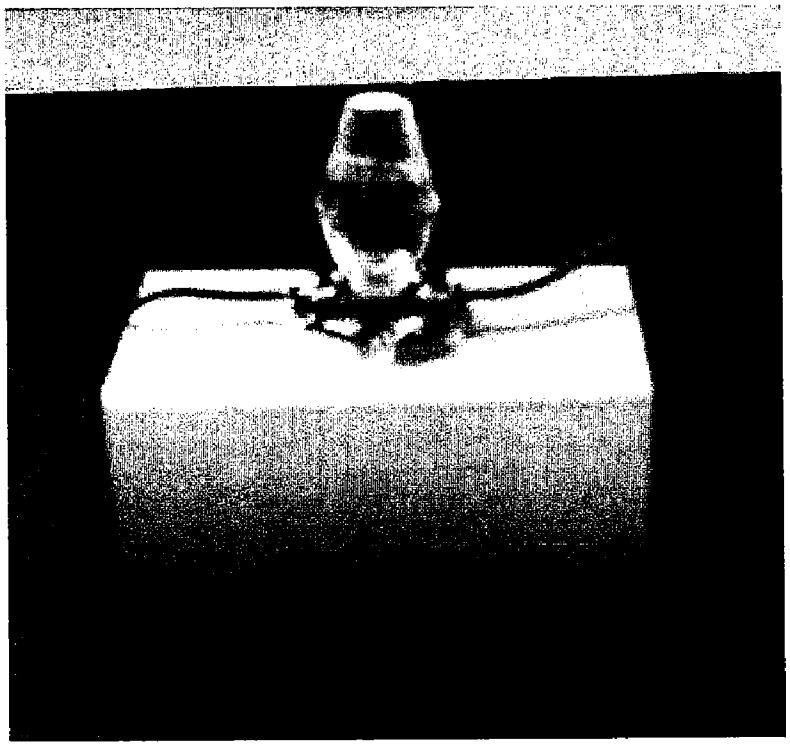

The top portion of the light guide can also be angle cut to various degrees. For example, FIGS. 5(*a*)-5(*d*) illustrate a tapered light guide having a flattened top portion with a flat surface orientation of 0°, 30°, 45°, and 60°, respectively. FIG. 5(*e*) is a 90° rotated view of the embodiment shown in FIG. 5(*d*), to further illustrate the light guide design. Furthermore, the top portion of the light guide can be spherical (ball) shaped, hemispherical, or conical, as shown in FIGS. 6(*a*)-6(*c*). FIGS. 6(*a*)-6(*c*) illustrate tapered light guides with the conical shaped top surface having an apex angle of 120°, 90°, and 60°, respectively. The remote down conversion material is placed at these end finishes at the top portion of the light guide. FIGS. 7(*a*)-(*b*) show a blue light emitting diode (LED) with a tapered light guide having a phosphor-coated top surface, in accordance with an embodiment of the present invention. FIG. 7(*a*) shows the SSL-based lamp in the "off" condition while FIG. 7(*b*) shows the SSL-based lamp in the "on" condition.

FIG. 8(*a*) shows a 3-dimensional rendering of one embodiment of the present invention which includes a white LED package as the light source. FIG. 8(*b*) shows a 3-dimensional exploded view of the embodiment shown in FIG. 8(*a*). These figures show heat sink 18 as having 6 heat sink fins 18*a* external the bulb envelope 20. Alternative embodiments of the present invention may utilize more or less heat sink fins. The heat sink 18 may alternatively, or additionally, include a mesh that extends from heat sink 18 and surrounds at least a portion of the outer surface of the bulb envelope 20 between the light source 16 and the bottom of the lamp base 12. The heat sink 18, heat sink fins 18*a*, and mesh may be manufactured of various heat dissipation materials known in the art, such as aluminum or copper. FIG. 8(*b*) also shows a break-through in the bulb envelope 20 for insertion of the second reflector 26 and light source 16 into the bulb envelope. The heat sink 18 is substantially external to the bulb envelope 20, and couples with the light source 16 at the break-through in the bulb envelope.

Figure 9A:
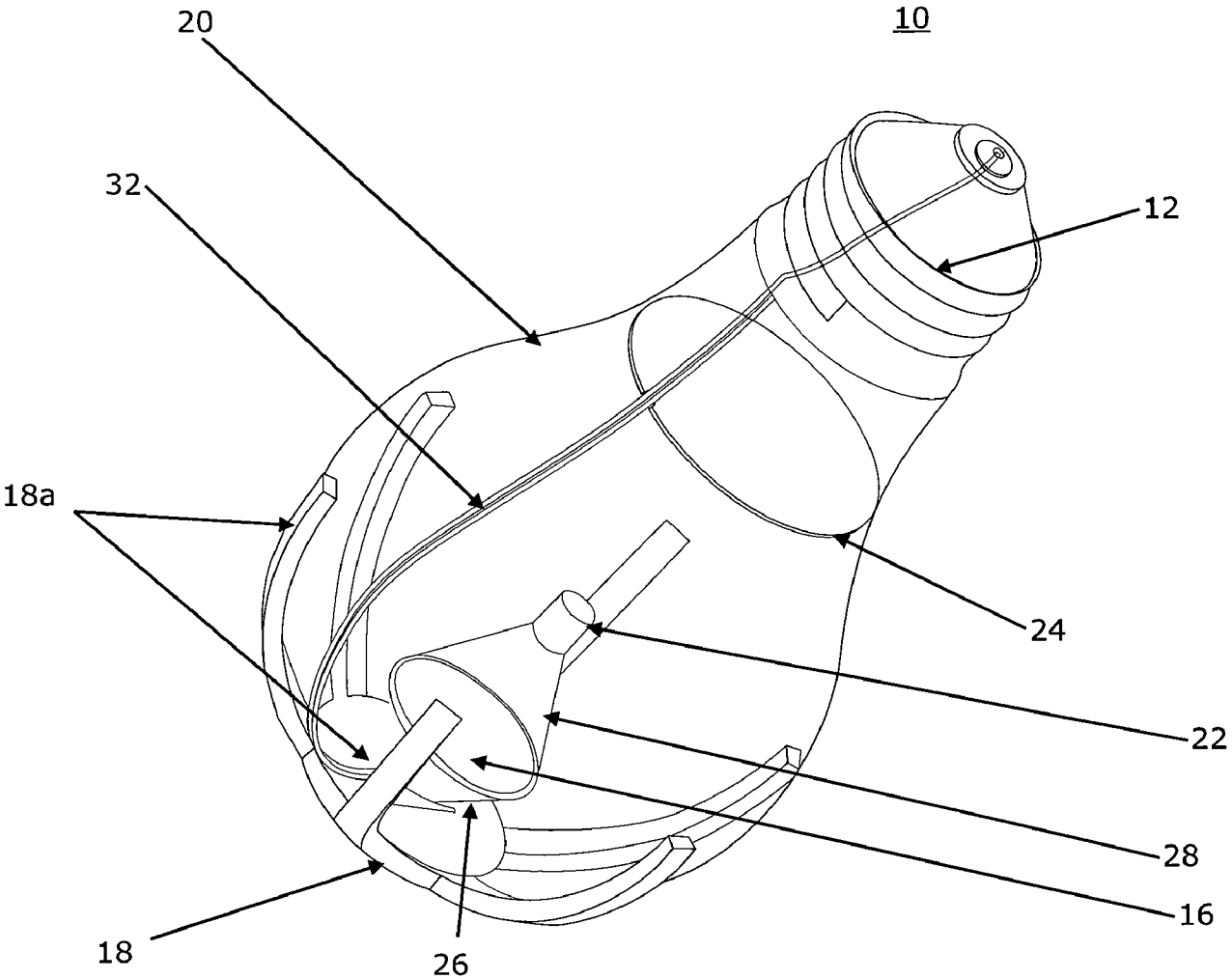
FIG. 9(*a*) shows a 3-dimensional rendering of another embodiment of the present invention which features an SPE type blue LED package.
Figure 9B:
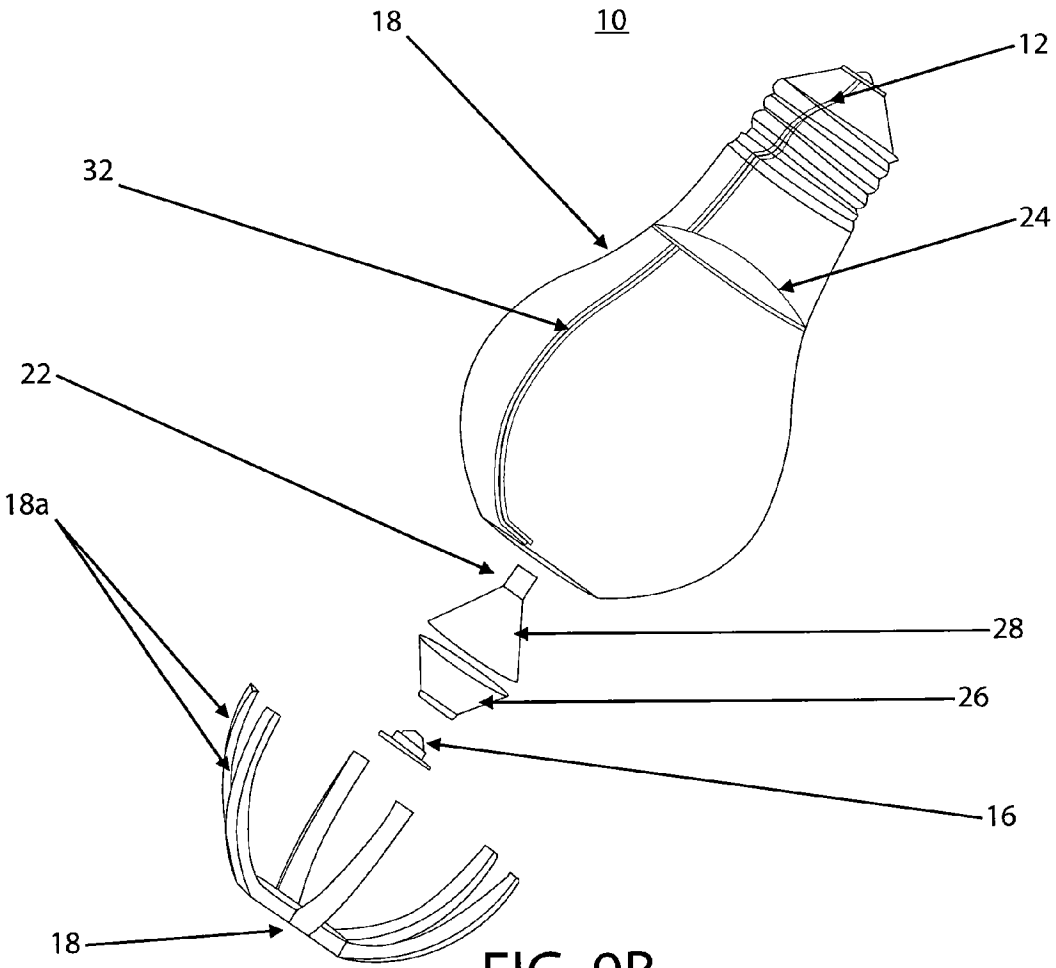

FIG. 9(*a*) shows a 3-dimensional rendering of another embodiment of the present invention which includes an SPE-type blue LED package as the light source. An SPE-type LED package utilizes scattered photon extraction (SPE) and includes, in at least one embodiment, an LED light source 16, a second reflector 26, a light guide 28, and a down conversion material 22 coupled together within a bulb envelope 20. FIG. 9(*b*) shows a 3-dimensional exploded view of the embodiment shown in FIG. 9(*a*). As shown in FIG. 3, the embodiment of the present invention shown in FIG. 9(*a*) and FIG. 9(*b*) include a small cylindrical down conversion material 22 atop a tapered light guide 28. Light guide 28 is coupled to a second reflector 26, in which the light source 16 is disposed. The second reflector 26 and light guide 28 function to direct substantially all of the light emitted from the light source 16 to the down conversion material 22. These figures also show a heat sink 18 having 6 heat sink fins 18*a* external the bulb envelope 20. Other embodiments of the present invention may include more or less heat sink fins. The heat sink 18 may alternatively, or additionally, include a mesh that extends from heat sink 18 and surrounds at least a portion of the outer surface of the bulb envelope 20 between the light source 16 and the bottom of the lamp base 12. The heat sink 18 is substantially external to the bulb envelope 20, and couples with the light source 16 at a break-through in the bulb envelope.

Figures 10A, 10B:
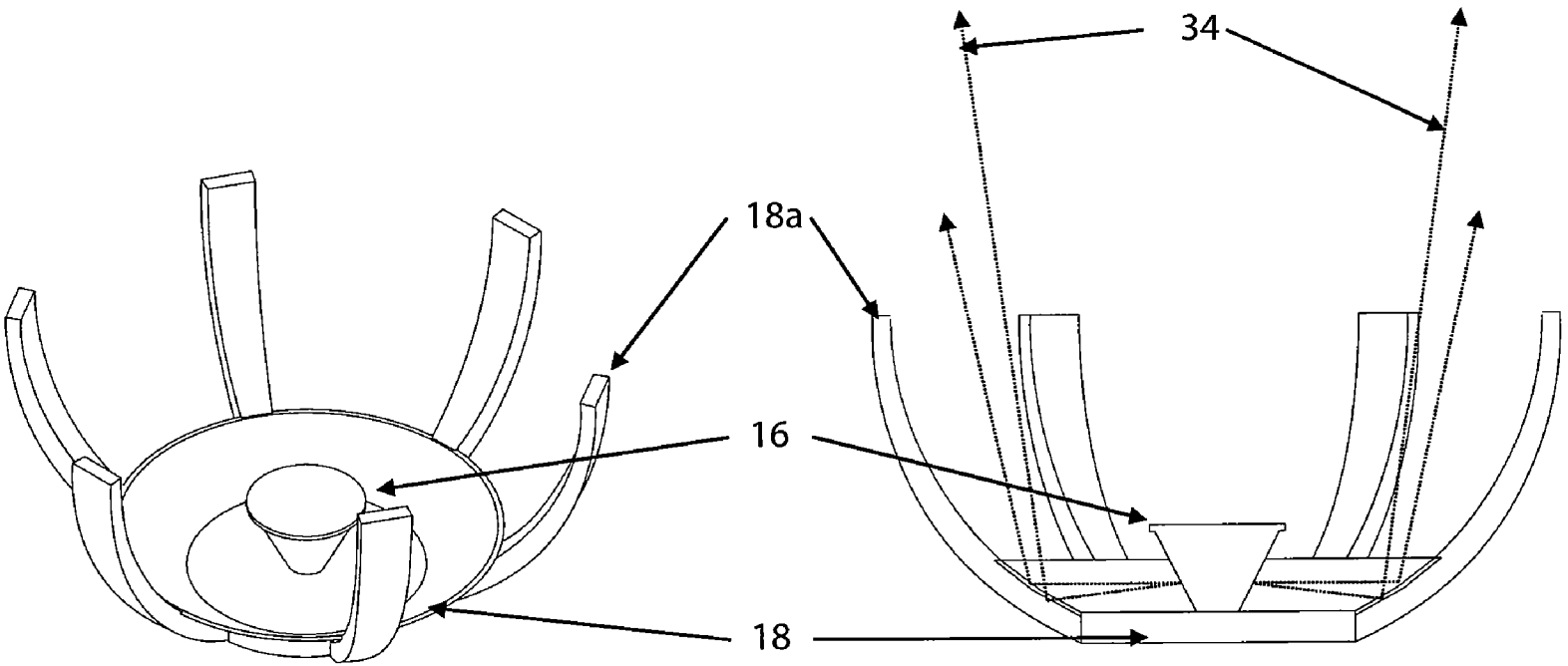
FIG. 10(*a*) shows a 3-dimensional view of a heat sink with 6 fins, according to an embodiment of the present invention.

In at least one embodiment of the present invention, the second reflector may be a component of, and integral to, the heat sink. FIG. 10(*a*) shows a 3-dimensional view, and FIG. 10(*b*) shows a cross-sectional view, of a light emitting apparatus according to this embodiment of the present invention. In other words, a portion of the heat sink coupled to the light source may be, or have the functionality of, a second reflector. In this configuration, the second reflector collects at least partially the light that is emitted sideways by the light source and directs it away from the light source to increase optical efficiency. As seen in FIGS. 10(*a*)-10(*b*), light source 16 is disposed within and/or coupled to heat sink 18. A portion of heat sink 18 coupled to light source 16 acts as a second reflector, to collect light emitted sideways from the light source and direct it away (depicted as dashed lines 34 in FIG. 10(*b*).

Figure 11B:
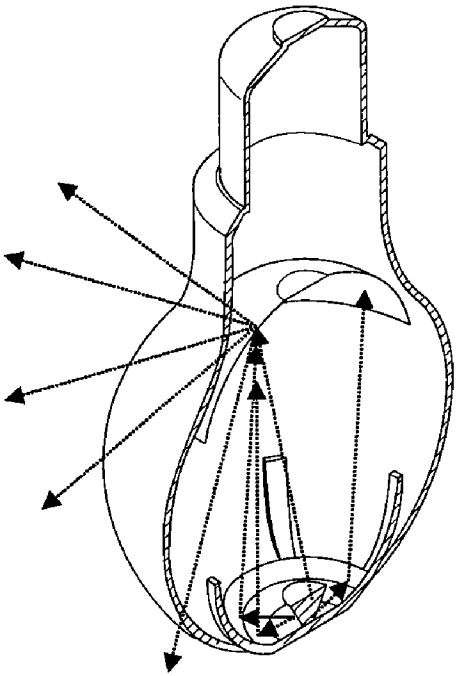
FIG. 11(*a*) illustrates a light source, a heat sink, and a parabolic first reflector, in accordance with another embodiment of the present invention.
Figure 11A:
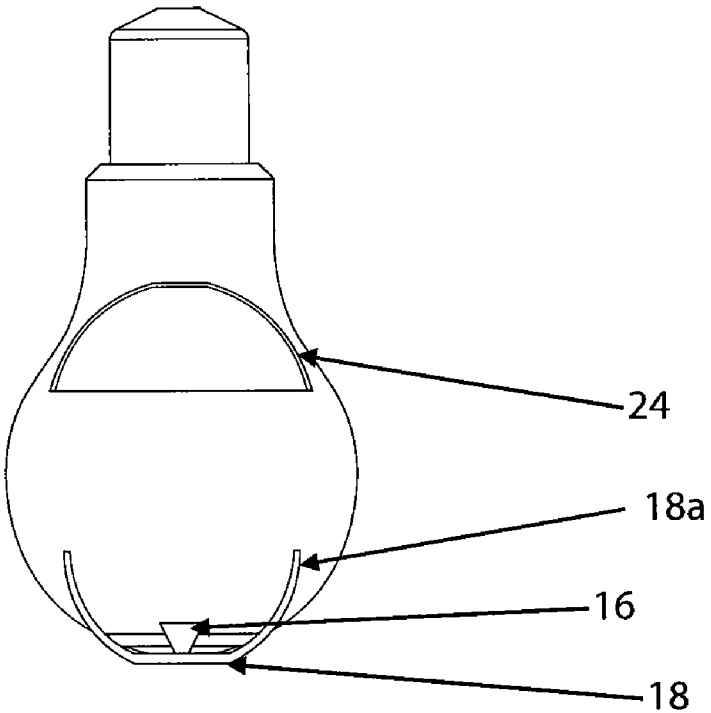
Figure 12B:
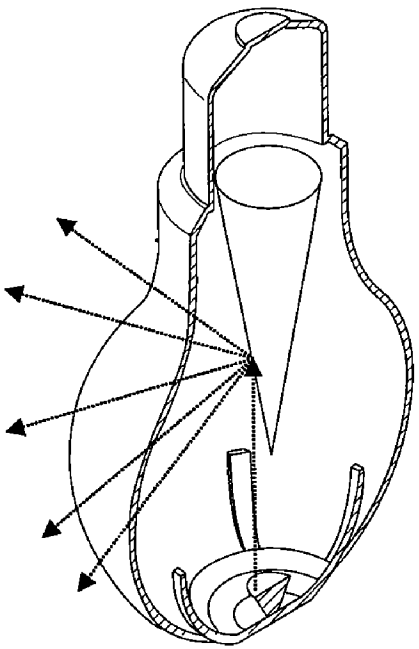
FIG. 12(*a*) illustrates a light source, a heat sink, and a conical first reflector, in accordance with another embodiment of the present invention.
Figure 12A:
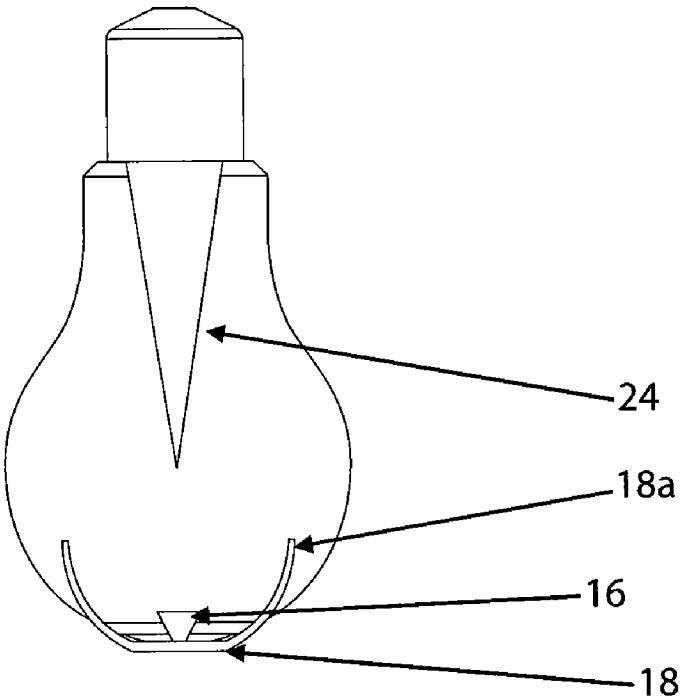

FIGS. 11(*a*)-11(*b*) and FIGS. 12(*a*)-12(*b*) show other embodiments of the present invention, which include a light source, a heat sink, and a first reflector. FIGS. 11(*a*)-11(*b*) show embodiments which include a parabolic first reflector, while FIGS. 12(*a*)-12(*b*) show embodiments which include a conical first reflector. As mentioned above, the first reflector may take any geometric shape such as, for example, spherical, parabolic, conical, and elliptical, and may be comprised of a variety of reflective surfaces known in the art. For example, the reflector may be aluminum, plastic with a vaporized aluminum reflective layer, or any other kind of reflective surface. Additionally, or alternatively, the reflector may be painted or treated to achieve a particular light distribution or aesthetic effect, or it can even transmit a small portion of the light to prevent hard shadows to be formed by the reflector. The reflector is positioned between the light source and the lamp base, and may be separate from, or adjacent to, the down conversion material when a down conversion material is employed. In at least one embodiment of the present invention, the down conversion material is applied to, and contained on, the reflector on a side facing the light source using conventional techniques known in the art. The reflector functions, for example, to enhance the optical efficiency of the SSL-based lamp.

The amount of heat from the LED light source and electronic driver going into the base of the lamp limits the total capacity of LEDs that can be used with reliable performance and, therefore, limits the amount of light that is produced. In presently available products which employ an LED and, optionally, a heat sink at or within the lamp base, the amount of light is typically limited to the equivalent of 25-40 W incandescent lamps. Embodiments of the present invention place the LED source and heat sink at the apex of the light bulb in order to dissipate more of the heat produced by the LEDs into the environment. This arrangement enables a greater amount of light to be produced (for example, the equivalent to a 60 W incandescent lamp) while ensuring that proper LED and electronic driver operating temperatures are maintained. This arrangement may be even more beneficial for applications where the LED lamp is used in open luminaires, when compared to benefits achieved in completely enclosed luminaires.

As stated before, the radiant energy hitting the down conversion material will be converted to a higher wavelength radiation and when mixed it will provide white light similar to the light produced by an incandescent A-lamp. The spectrum of the final light output depends on the down conversion material. The total light extraction depends on the amount of light reaching the down conversion layer, the thickness of the down conversion layer, and the materials and design of the reflector. The light guide can be shaped and sized in any design contemplated to achieve the performance and aesthetic goals of the SSL-based lamp. The Examples and Tables below detail various exemplary shapes for the light guide and the effects each of these shapes may have on efficiency and light radiation of the SSL-based lamp.

EXAMPLES

In at least one embodiment of the present invention, an LED package with scattered photon extraction (SPE) is implemented. Unlike a typical conventional white LED package, where the down conversion phosphor is spread around the light source or die, in the SPE package of the invention the phosphor layer is moved away from the die, leaving a transparent medium between the die and the phosphor. An efficient geometrical shape for such packages may be determined via ray tracing analysis. It is worth noting that the SPE package requires a different phosphor density to create white light with chromaticity coordinates similar to the conventional white LED package. This difference is a result of the SPE package mixing transmitted and back-reflected light with dissimilar spectra, whereas the conventional package uses predominantly the transmitted light.

A ray tracing analysis to assess the feasibility of the light guide concept was performed. Additionally, a laboratory evaluation was conducted to study the total light output and the luminous efficacy. Computer simulations were conducted to determine the light coupled into a tapered light guide, the output white light, and the total efficacy of the system. A base model consisted of a blue LED with a remote phosphor and a total internal reflected (TIR) lens as a second reflector. The blue LED had a Lambertian intensity distribution and a spectral peak wavelength of 451 nm. The TIR lens was mounted on top of the LED to collimate the light beam from the blue LED to the top surface of the TIR lens (as shown in FIG. 4(*a*)). A tapered light guide was then cemented on top of the TIR lens.

Simulated Tests

To determine the operating and preferred geometric size of the tapered light guide, a 50 mm high conical shaped tapered light guide was first tested. The bottom surface of the tapered light guide possessed the same diameter-width as the TIR lens top surface. To couple more light to the top surface of the tapered light guide and minimize the top surface area, a series of light guide heights were simulated (as shown in FIG. 4(*c*) through FIG. 4(*e*)) and the optimal height of the light guide selected was 35 mm, as shown in Table 1. If a shorter height tapered light guide is used, there is a trade-off between the increased amount of light received on the top surface and the larger focus area at the top surface. A smaller area at the top surface means less phosphor is used and a better focused light beam can be generated. Considering this trade-off, a 35 mm high tapered light guide was selected with relatively smaller top surface area and higher ratio of light forward transmitted from the top surface.

TABLE 1

The radiant power from the top surface of the tapered light guide with different heights.

| Length of tapered light guide | Total Radiant P(W) | Top Surface Radiant P(W) | Radiant Percentage (Top surface/Total) |
|---|---|---|---|
| 40 mm | 0.956 | 0.613 | 64% |
| 35 mm | 0.972 | 0.796 | 82% |
| 30 mm | 0.982 | 0.820 | 84% |

After the geometric size of the tapered light guide was determined, the flat circular top surface of the tapered light guide was coated with a 0.24 mm thick down converting phosphor layer. Various orientations of the flat top surface of the tapered light guide were simulated as shown in FIG. 5(*a*) through FIG. 5(*e*). Table 2 illustrates the light output and chromaticity from each tapered light guide white LED package. The simulations show that when the top surface was orientated at 60 degrees, the light output and hence the system efficacy reached the maximum with similar chromaticity values. However, the high light output and system efficacy is a trade-off with the larger amount of phosphor to be used. One disadvantage from the flat top surface tapered light guide is the non-uniformity of the spatial color distribution, which is caused from the asymmetric spatial distribution of the phosphor coating.

TABLE 2

Radiant power and chromaticity of the tapered light guide white LED package with various top surface orientations.

| Top surface orientation angle [degrees] | Total Radiant P(W) | Chromaticity X | Chromaticity Y |
|---|---|---|---|
| 0 | 0.811 | 0.288 | 0.291 |
| 30 | 0.827 | 0.286 | 0.288 |
| 45 | 0.811 | 0.286 | 0.288 |
| 60 | 0.854 | 0.290 | 0.299 |

To overcome the potential disadvantage from the flat top surface tapered light guide, another type of tapered light guide with a conical shaped top surface was simulated. The conical shaped top surface is like the end of a pencil as shown in FIG. 6(*a*) to FIG. 6(*c*). Three different apex angles of the conical shaped top surface were simulated, each having a 0.24 mm thick uniform layer of phosphor coating covering the conical shaped top surface. As demonstrated in Table 3, the 60 degree conical-shaped-top-surface tapered light guide yielded the highest light output in radiant power with matching chromaticity values. This related to the highest system efficacy. However, the high light output and system efficacy results were again found to be at the cost of a larger amount of phosphor needed. It was identified that the conical-shaped-top-surface tapered light guide provides better spatial color uniformity than the flat-top-surface tapered light guide.

TABLE 3

Radiant power and chromaticity of the conical-shaped-top-surface tapered light guide package with various apex angles

| Apex angle of conical top surface [degrees] | Total Radiant P(W) | Chromaticity X | Chromaticity Y |
|---|---|---|---|
| 120 | 0.808 | 0.290 | 0.293 |
| 90 | 0.807 | 0.290 | 0.294 |
| 60 | 0.822 | 0.289 | 0.294 |

Laboratory Studies

A lens used for coupling light in to cylindrical optical light guides was used with a high power blue LED. A thin layer of YAG:Ce phosphor was coated on top of the lens with area density of 8 mg/cm$^2$. A laboratory study was conducted with the blue LED driven under 350 mA. The chromaticity, light output, and system efficacy was measured in a calibrated integrating sphere. As shown in Table 4, compared with the scattered photon extraction (SPE) package, this remote phosphor white LED package is 11% less efficient. However, the SPE packages were verified earlier to be 61% more efficient than the conventional phosphor-converted white LED packages. Accordingly, this novel tapered light guide white LED package is approximately 50% more efficient than the conventional phosphor-converted white LED package. Additionally, less phosphor was utilized in this new tapered light guide white LED package than the conventional system, and a more focused light beam was generated from the new white LED package. The better focused light beam and less usage of the phosphor is ideal in the LED A-lamp for application purpose as well as cost considerations.

TABLE 4

Light output, system efficacy and chromaticity of the tapered lens white LED package compared with the previous SPE Package.

| LED | Lens | Phosphor area density | ϕ (lm) | Efficacy (lm/W) | CIE1931 (x, y) x | y |
|---|---|---|---|---|---|---|
| High power blue | SPE | 6 mg/cm$^2$ | 97.4 | 89.6 | 0.312 | 0.324 |
| High power blue | Tapered Lens | 8 mg/cm$^2$ | 86.4 | 79.6 | 0.310 | 0.317 |

It will be understood that the geometry of the SSL-based lamp is not limited to the specific shapes shown in the Figures, described above, or presented in the Examples. Alternate shapes may be used to achieve specific performance or aesthetics, while addressing other design concerns, such as light color and bulb life. Although the invention has been described with reference to exemplary embodiments, it is not limited thereto. Rather, the appended claims should be construed to include other variants and embodiments of the invention which may be made by those skilled in the art without departing from the true spirit and scope of the present invention.

What is claimed is:

1. A light emitting apparatus comprising:

a lamp base;

a light-transmissive bulb envelope, a first portion of the bulb envelope coupled to the lamp base;

a light source for emitting light, at least a portion of the light source disposed external to the bulb envelope at an end substantially opposite the lamp base;

a down conversion material for receiving and down converting at least some of the light emitted by the light source and back transferring a portion of the received and down converted light, the down conversion material disposed within the bulb envelope, remote from the light source and between the light source and the lamp base;

a reflector for receiving and reflecting the light emitted by the light source and down converted by the down conversion material, the reflector disposed within the bulb envelope between the down conversion material and the lamp base; and a heat sink coupled to the light source, at least a portion of the heat sink external to the bulb envelope.

2. The apparatus according to claim 1 further comprising a light guide for directing the light emitted by the light source, a first end of the light guide coupled to the light source and a second end of the light guide coupled to the down conversion material.

3. The apparatus according to claim 2, wherein the light guide is either a cylinder, or a tapered cylinder, the cylinder or tapered cylinder having an upper portion selected from the group consisting of angle cut, flat, pointed, spherical, hemispherical, and conical.

4. The apparatus according to claim 1, wherein the light source is at least one light emitting diode (LED).

5. The apparatus according to claim 1, wherein at least a portion of the heat sink projects into the bulb envelope.

6. The apparatus according to claim 1, further comprising at least a second reflector for directing the light emitted from the light source, the light source disposed within the reflector.

7. The apparatus of claim 6, wherein the second reflector for directing the light emitted from the light source is selected from the group consisting of a reflector cup and an optical lens.

8. The apparatus according to claim 6, wherein the second reflector is an integral component of the heat sink.

9. The apparatus according to claim 1, wherein the light source comprises a plurality of light emitting diodes, the light emitting diodes disposed within at least one reflector.

10. The light emitting apparatus of claim 1, wherein the down conversion material comprises at least one wavelength-converting material adapted to absorb radiation in one spectral region and emit radiation in another spectral region.

11. The light emitting apparatus of claim 10, wherein the at least one wavelength-converting material is at least one phosphor.

12. The apparatus according to claim 1, wherein the reflector is adjacent the down conversion material.

13. The apparatus according to claim 1, wherein the heat sink comprises a mesh disposed over at least an outer portion of the bulb envelope.

14. The apparatus according to claim 1, further comprising an electronic driver disposed within the bulb envelope.

15. The apparatus of claim 14, wherein at least a portion of the electronic driver is disposed within the lamp base.

16. The apparatus according to claim 1, wherein the heat sink comprises a mesh disposed over at least an outer portion of the bulb envelope.

17. A light emitting apparatus comprising:

a lamp base;

a light-transmissive bulb envelope, a first portion of the bulb envelope coupled to the lamp base;

a light source for emitting light, at least a portion of the light source disposed external with the bulb envelope at an end substantially opposite the lamp base;

a down conversion material for receiving and down converting at least a portion of the light emitted by the light source and back transferring a portion of the received and down converted light, the down conversion material disposed within the bulb envelope, remote from the light source and between the light source and the lamp base;

a light guide for directing the light emitted by the light source, a first end of the light guide coupled to the light source and a second end of the light guide coupled to the down conversion material;

a reflector for receiving and reflecting the light emitted by the light source and down converted by the down conversion material, the reflector disposed within the bulb envelope between the down conversion material and the lamp base; and a heat sink coupled to the light source, at least a portion of the heat sink external to the bulb envelope.

18. The light emitting apparatus of claim 17, wherein the light guide is a cylinder.

19. The light emitting apparatus of claim 17, wherein the light guide is a tapered cylinder.

20. The light emitting apparatus of claim 19, wherein the tapered cylinder light guide has an upper portion selected from the group consisting of angle cut, flat, pointed, spherical, hemispherical, and conical.

* * * * *